US008465066B2

(12) United States Patent
Zinn

(10) Patent No.: US 8,465,066 B2
(45) Date of Patent: Jun. 18, 2013

(54) SWIVEL BEARING FOR A PRESSING MECHANISM OF A CLOSING DEVICE

(75) Inventor: Jürgen Zinn, Heiligenhaus (DE)

(73) Assignee: Steinbach & Vollmann GmbH & Co. KG (DE)

( * ) Notice: Subject to any disclaimer, the term of this patent is extended or adjusted under 35 U.S.C. 154(b) by 451 days.

(21) Appl. No.: 12/443,649

(22) PCT Filed: Oct. 5, 2007

(86) PCT No.: PCT/EP2007/008650

§ 371 (c)(1),
(2), (4) Date: May 28, 2009

(87) PCT Pub. No.: WO2008/040552

PCT Pub. Date: Apr. 10, 2008

(65) Prior Publication Data

US 2010/0239200 A1 Sep. 23, 2010

(30) Foreign Application Priority Data

Oct. 7, 2006 (DE) ..... 10 2006 047 561

(51) Int. Cl.
*E05B 3/00* (2006.01)
*E05C 3/02* (2006.01)

(52) U.S. Cl.
USPC ..... 292/336.3; 292/194; 292/DIG. 71

(58) Field of Classification Search
USPC ..... 292/1, 57, 66, 108, 194, 350, 354, 292/356–357, 336.3, DIG. 53, DIG. 64, DIG. 71; 16/110.1
See application file for complete search history.

(56) References Cited

U.S. PATENT DOCUMENTS

| | | | | | |
|---|---|---|---|---|---|
| 162,011 | A | * | 4/1875 | Barr | 292/116 |
| 444,826 | A | * | 1/1891 | Glockler | 292/241 |
| 751,495 | A | * | 2/1904 | Gauchet | 292/57 |
| 1,100,274 | A | * | 6/1914 | Wirfs | 292/242 |
| 1,573,866 | A | * | 2/1926 | Rogers | 292/113 |
| 1,659,849 | A | * | 2/1928 | Winters et al. | 292/228 |
| 1,789,394 | A | * | 1/1931 | Summers | 292/98 |
| 2,648,967 | A | * | 8/1953 | Holmsten | 70/89 |
| 3,719,960 | A | * | 3/1973 | Russell | 4/556 |
| 3,746,382 | A | * | 7/1973 | Hancock | 292/241 |
| 5,456,505 | A | * | 10/1995 | Yamada | 292/202 |
| 5,469,661 | A | | 11/1995 | Finkelstein et al. | |
| 5,704,662 | A | * | 1/1998 | Kwiatkowski | 292/194 |

(Continued)

FOREIGN PATENT DOCUMENTS

| | | | | |
|---|---|---|---|---|
| EP | 1 460 205 | A | | 9/2004 |
| GB | 2064639 | A | * | 6/1981 |
| WO | WO-97/38273 | A | | 10/1997 |

OTHER PUBLICATIONS

Translation of International Preliminary Report on Patentability for PCT/EP2007/008650 (Jul. 2, 2009).

*Primary Examiner* — Carlos Lugo
*Assistant Examiner* — Alyson M Merlino
(74) *Attorney, Agent, or Firm* — Harness, Dickey & Pierce, P.L.C.

(57) ABSTRACT

The invention relates to a swivel bearing for a pressing mechanism of a closing device. In order to create a swivel bearing that is easy to mount and inexpensive to produce, the pivotable unit is connected to the base plate by a journal located on the pivotable unit.

11 Claims, 9 Drawing Sheets

Figure 1:
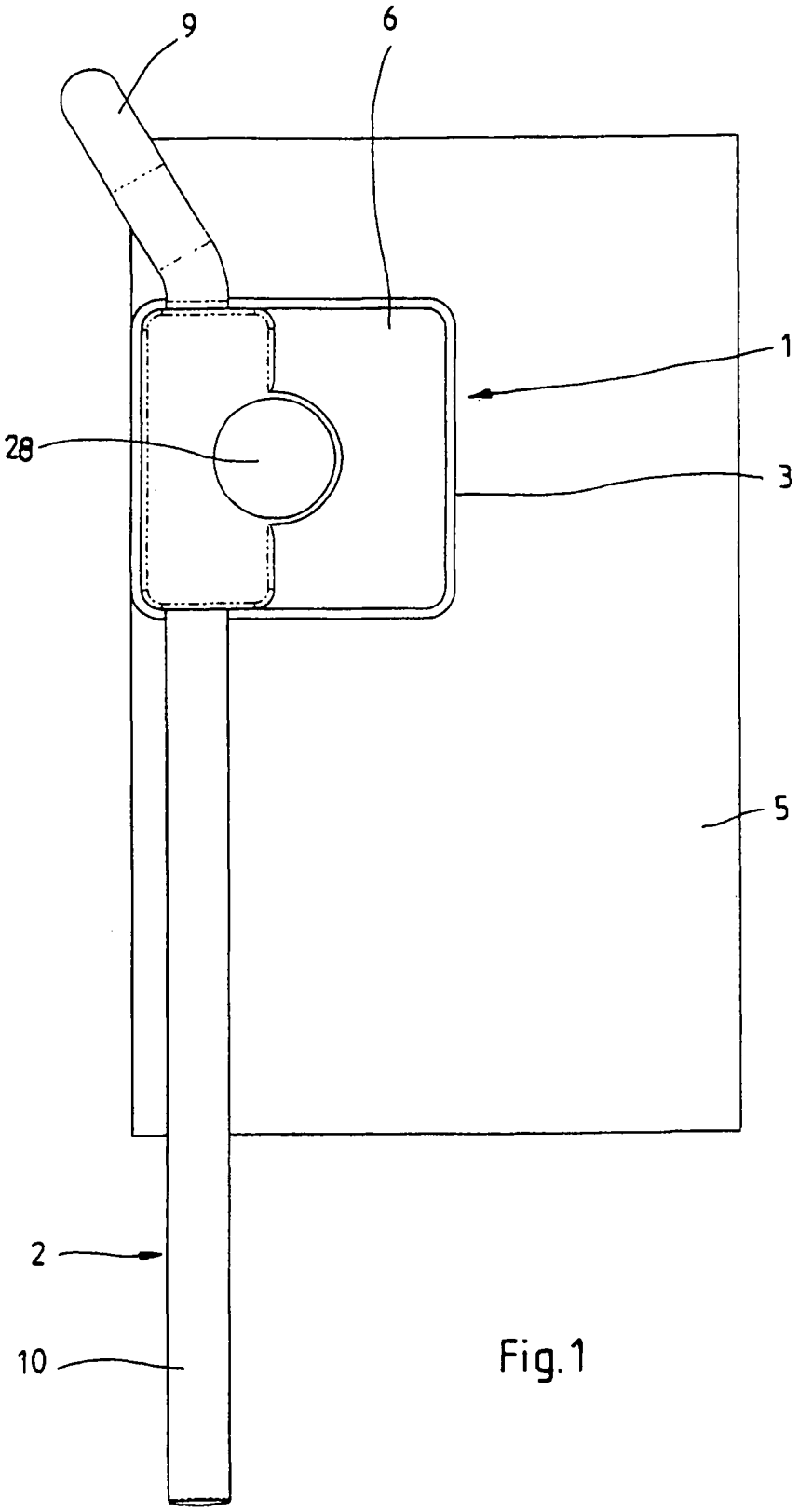

U.S. PATENT DOCUMENTS 6,932,392 B1 * 8/2005 Geislhardt ..... 292/61
7,048,312 B2 * 5/2006 Brunner ..... 292/163
7,100,951 B2 * 9/2006 Jien ..... 292/207
7,690,701 B2 * 4/2010 Van Ravenhorst ..... 292/194

* cited by examiner

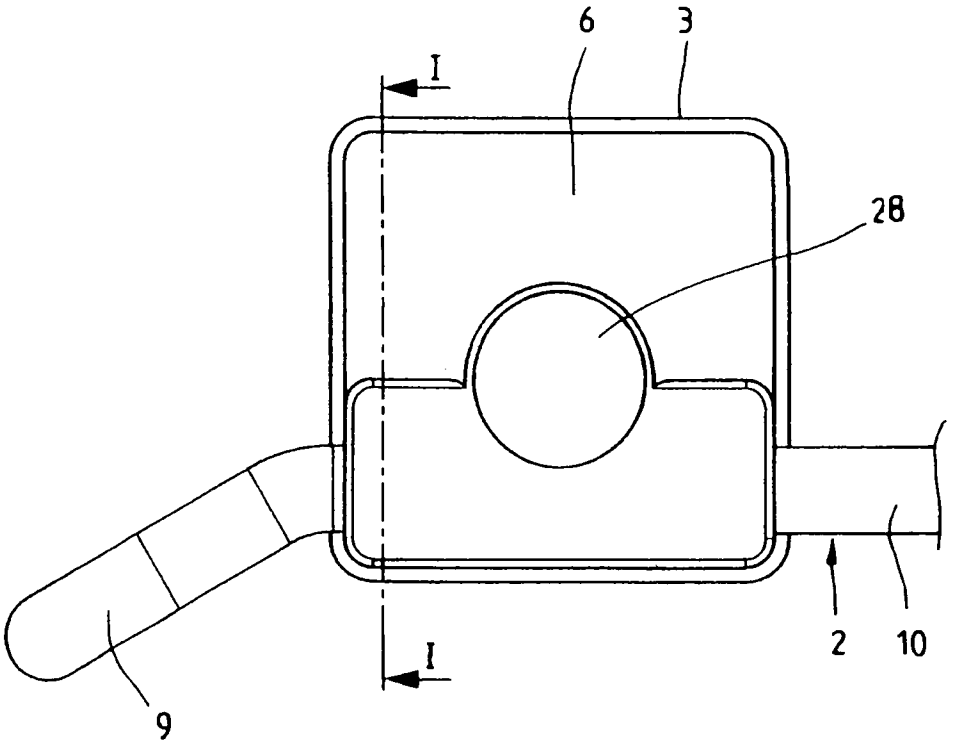
Fig. 8
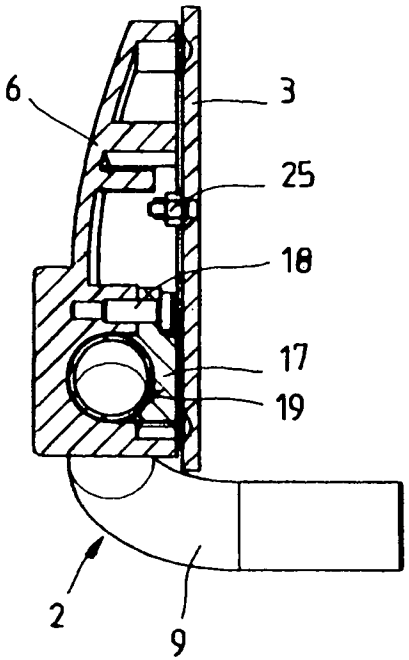

SWIVEL BEARING FOR A PRESSING MECHANISM OF A CLOSING DEVICE

CROSS-REFERENCE TO RELATED APPLICATIONS

This application is a U.S. National Stage Application of International application No. PCT/EP2007/008650, filed Oct. 5, 2007. This application claims the benefit of German Application No. 10 2006 047 561.5 filed Oct. 7, 2006. The disclosures of the above applications are incorporated herein by reference.

The present invention relates to a swivel bearing for a pressing mechanism of a closing device, which swivel bearing is composed of a base plate that can be fixed to a closing device and of a pivotable unit.

Swivel bearings for pressing mechanisms are known. Pressing mechanisms allow easy opening and closing of closing devices. Such a pressing mechanism is composed of a swivel bearing and a lever arm fixed to the swivel bearing and the swivel bearing is fixed through a base plate to the closing device. At the operation of the pressing mechanism of closing devices the load arm of the lever arm is removed from an abutment arranged on the frame of the closing device or from the frame itself. Thus a holding device holding the closing device in the closing position can be surmounted. If the pivoting of the pressing mechanism is continued, the closing device receives an impetus through this removing action and this impetus facilitates the movement of the closing device to the open position. After its operation the pressing mechanism returns to its rest position.

In the following description the term "closing device" is understood to mean devices for closing an opening such as sliding doors, partitions and similar movable closing devices.

In the patent specification EP 1 460 205 A1 a pressing mechanism for sliding doors is described, in which the swivel bearing consists of a rotating plate supported on a base plate, fixing elements for the lever arm and a cover. The lever arm is fixed to the rotating plate by means of screw-fixed straps and is secured against twisting on the rotating plate by means of supports fixed on the rotating plate. Between the rotating plate and the base plate sliding bodies are provided which provide for a damping of the movement of the swivel bearing. The movement of the swivel bearing is limited by a bolt provided on the base plate and guided in a circular ring sector-like slot in the rotating plate. Also provided is a spring mechanism which restores the pressing mechanism to its original position after operation.

The disadvantage of the above-described pressing mechanism for sliding doors resides in the use of swivel bearings which are composed of a great number of components, thus causing high production costs and complicated assembly.

The invention is thus based on the object of providing a swivel bearing for pressing mechanisms of closing devices that is easy to mount and inexpensive to produce.

This object is achieved by the invention described herein, by providing a swivel bearing which comprises only a few components.

The swivel bearing for pressing mechanisms of closing devices according to the invention comprises a unit which is pivotable with respect to the base plate and which is connected to the base plate by a journal arranged on the pivotable unit. Any rotating plate or the like is not provided between the base plated fixed to the closing device and the pivotable unit, so that less components are required than in conventional swivel bearings.

An advantageous embodiment of the invention provides a base plate which includes in its center a cylindrical journal to which the sleeve-like journal of the pivotable unit is attached. The inner radius of the journal of the pivotable unit is larger than the outer radius of the journal of the base plate.

A further advantageous embodiment of the invention provides that the journal of the base plate has fixed to it a cylindrical guide sleeve to which the pivotable unit is attached and which positively connects the pivotable unit to the base plate. The guide sleeve also serves to improve the sliding properties during the pivoting of the pivotable unit with respect to the base plate. The material from which the guide sleeve is made is preferably a plastic material, although a different material like metal or a ceramic material supporting the desired sliding properties may be employed as well.

According to a further advantageous embodiment of the invention an additional cylindrical guide sleeve is arranged on the sleeve-like journal of the pivotable unit, and preferably this guide sleeve is designed in such a way that it abuts against the guide sleeve arranged on the journal of the base plate, after the pivotable unit has been attached to the first guide sleeve within the sleeve-like journal. But it can also be provided that a space is left between the two guide sleeves. The two guide sleeves guarantee zero clearance pivoting of the swivel bearing.

A further advantageous embodiment of the invention provides that a fixing element is mounted to the swivel bearing. This fixing element connects the pivotable unit to the base plate in such a way that the pivotable unit only has the two degrees of freedom of rotation about the journal arranged on the base plate. To achieve this, the fixing element is arranged on the journal of the base plate. The fixing element can for example be a nut, a locking ring, a pin or any other element suitable for this purpose. It can also be provided that the fixing element is shimmed by a washer preventing the nut from loosening.

A further advantageous embodiment of the invention provides that a lever arm is fixed to the pivotable unit. To this end, the pivotable unit comprises a holding element which is preferably screwed to the pivotable unit. The holding element can be designed for example as an elongate element including a recess for receiving the lever arm, said recess having a shape complementary to the shape of the lever arm. A different embodiment would be a holding device formed by at least one screwing fastener. A narrowing sleeve or any other expedient form could also be conceived for the holding element. The lever arm could also have bores for receiving screws allowing direct screwing of the lever arm to the pivotable unit. By fixing the lever arm directly to the pivotable unit an additional component such as a rotating plate is not required, thus reducing the number of components that are required.

According to a further advantageous embodiment of the invention at least one damper element is provided on the pivotable unit to damp the pivoting movement and thus prevent the lever arm together with the pivotable unit from oscillating after a previous excursion. This damper element guarantees safe handling of the pressing mechanism, because a free oscillation for example of the lever arm could cause injuries to individuals or damages on the frame of the closing device.

In a preferred embodiment of the invention the damper element has the form of a telescoping damper element that can extend and withdraw and that offers resistance to a fast pivoting movement. But other embodiments are also conceivable, such as for instance damping by means of rubber elements, springs or the like. Advantageously, the damper element is connected to the pivotable unit on one side and to the base plate on the other side. This connection can be accomplished by screwing, riveting or the like on appendices or webs.

According to a further advantageous embodiment of the invention the pivotable unit at least includes one limiting element that limits the pivoting movement of the pivotable unit. This prevents inappropriate handling of the pressing mechanism by providing for a pivoting movement to an extent that allows surmounting of the holding device and the closing device and a facile push-start of the closing device, but does not exceed this extent. For this purpose also a telescoping element or limit stops can be provided both on the pivotable unit and on the base plate.

A further advantageous embodiment of the invention provides that the damper element and the limiting element are constructed as one element. Thus the number of necessary components is reduced for the purpose of solving the objective problem according to the invention.

A further advantageous embodiment of the invention provides that the pivotable unit is constructed in the form of a housing that protects the components of the swivel bearing and also protects extremities of individuals from injuries that might be caused by reaching into the mechanism of the swivel bearing. The housing can have a different shape, e.g. square, round or rounded on one side, so as to meet the technical and optical requirements.

A further advantageous embodiment of the invention provides that the load arm of the lever arm is shorter than the force arm, which fact makes handling of the pressing mechanism easier. The force arm can be designed in different ways as a handle. The force arm could have for instance an oval, elliptic, circular or polygonal cross section. The force arm could further have a larger cross section than the load arm or be coated with a material which preferably consists of plastic. It is also conceivable that the force arm forms a separate element which is fixed, for example attached, to the rest of the lever arm to allow the force arm to be exchanged.

A further advantageous embodiment of the invention provides that the load arm is bent with respect to the force arm, so that the force arm is in a position that can be conveniently reached by an individual, whereas the load arm is bent towards the abutment or towards the frame of the closing device from which the pressing mechanism is forced off, so that the ways of the pivoting movement can be short.

According to a further advantageous embodiment of the invention a part of the load arm of the lever arm is bent vertically to the plane of the closing device in the direction of the closing device. Thus a larger force-off surface is obtained and the bent part of the load arm can thus be arranged in a gap between the closing device and the frame of the closing device.

Figure 2:
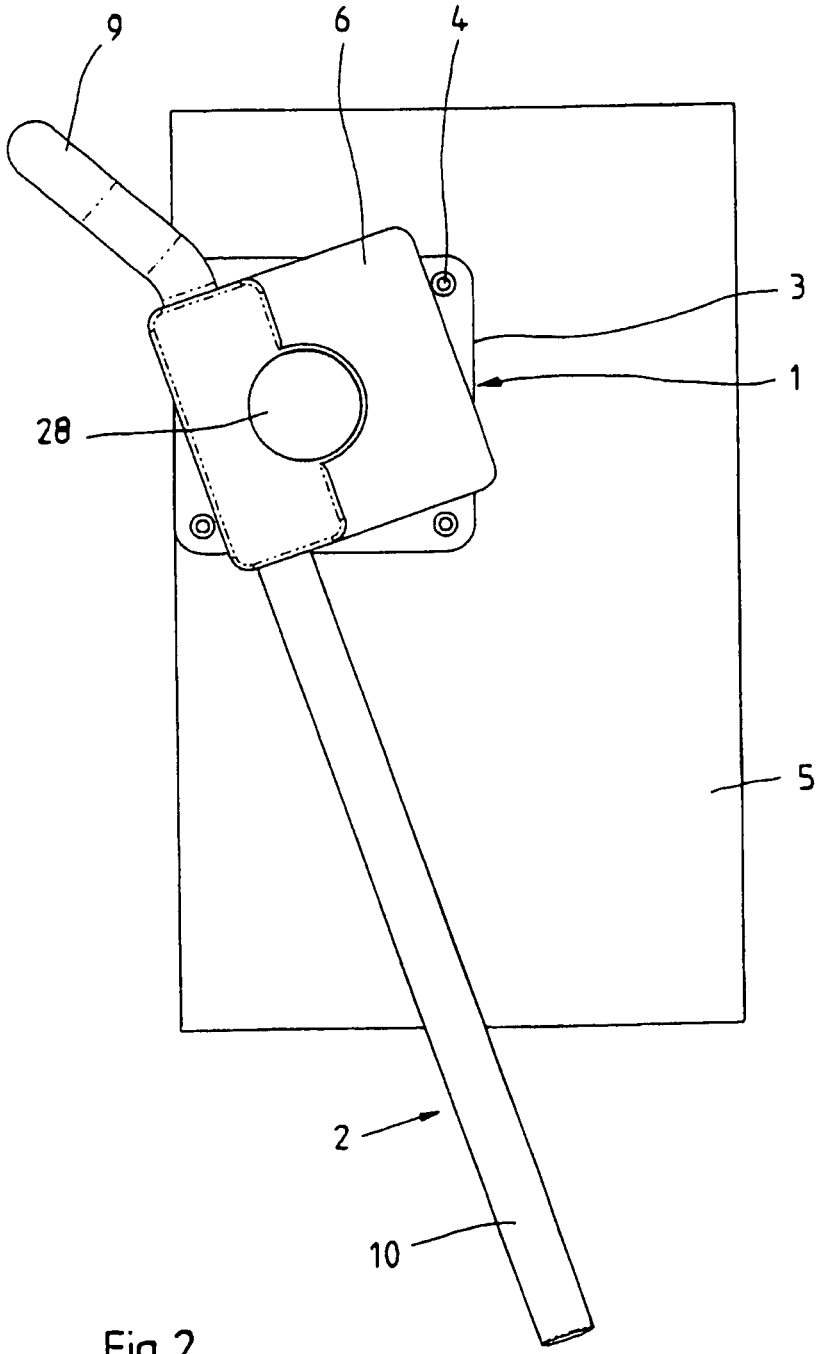
Figure 3:
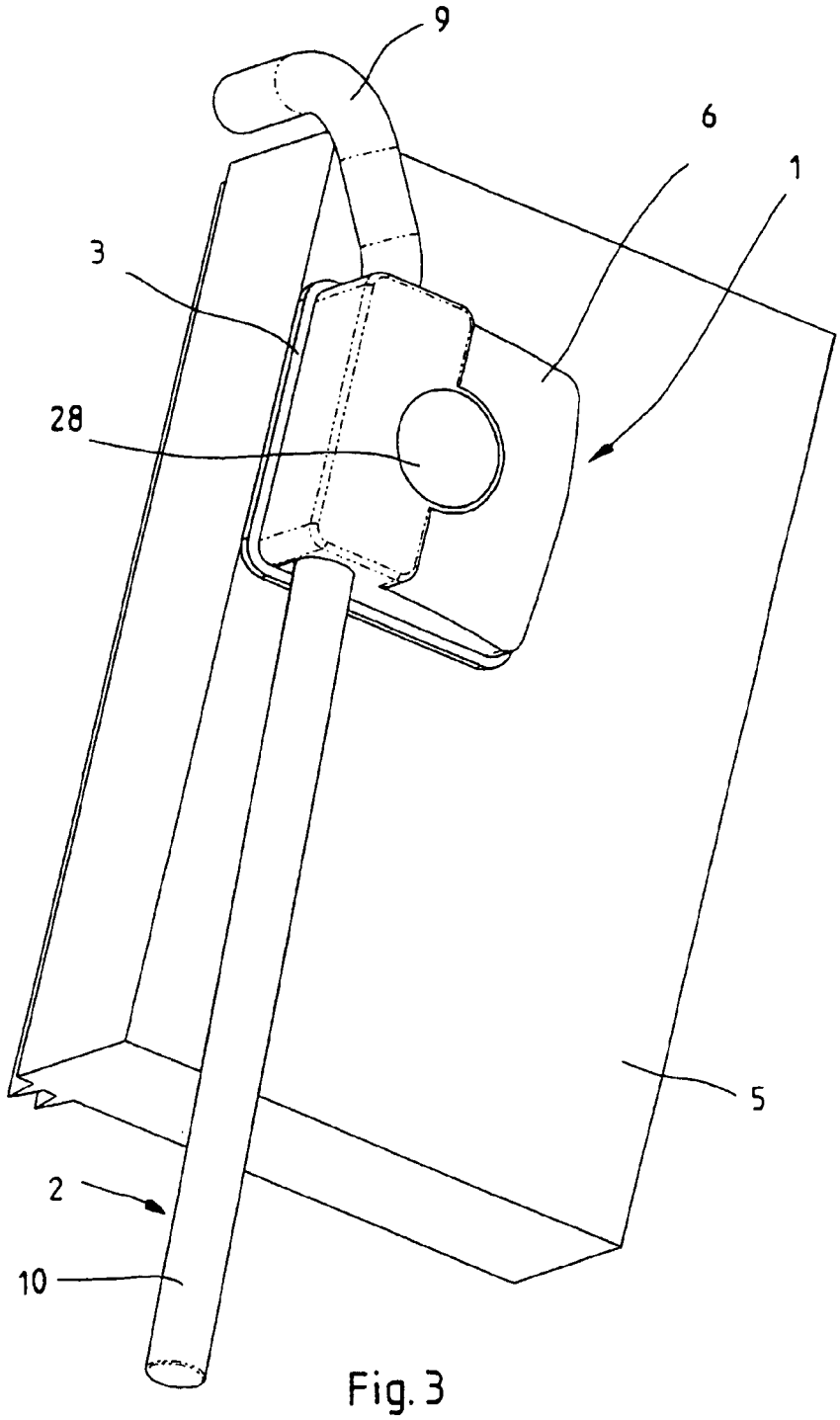
Figure 4:
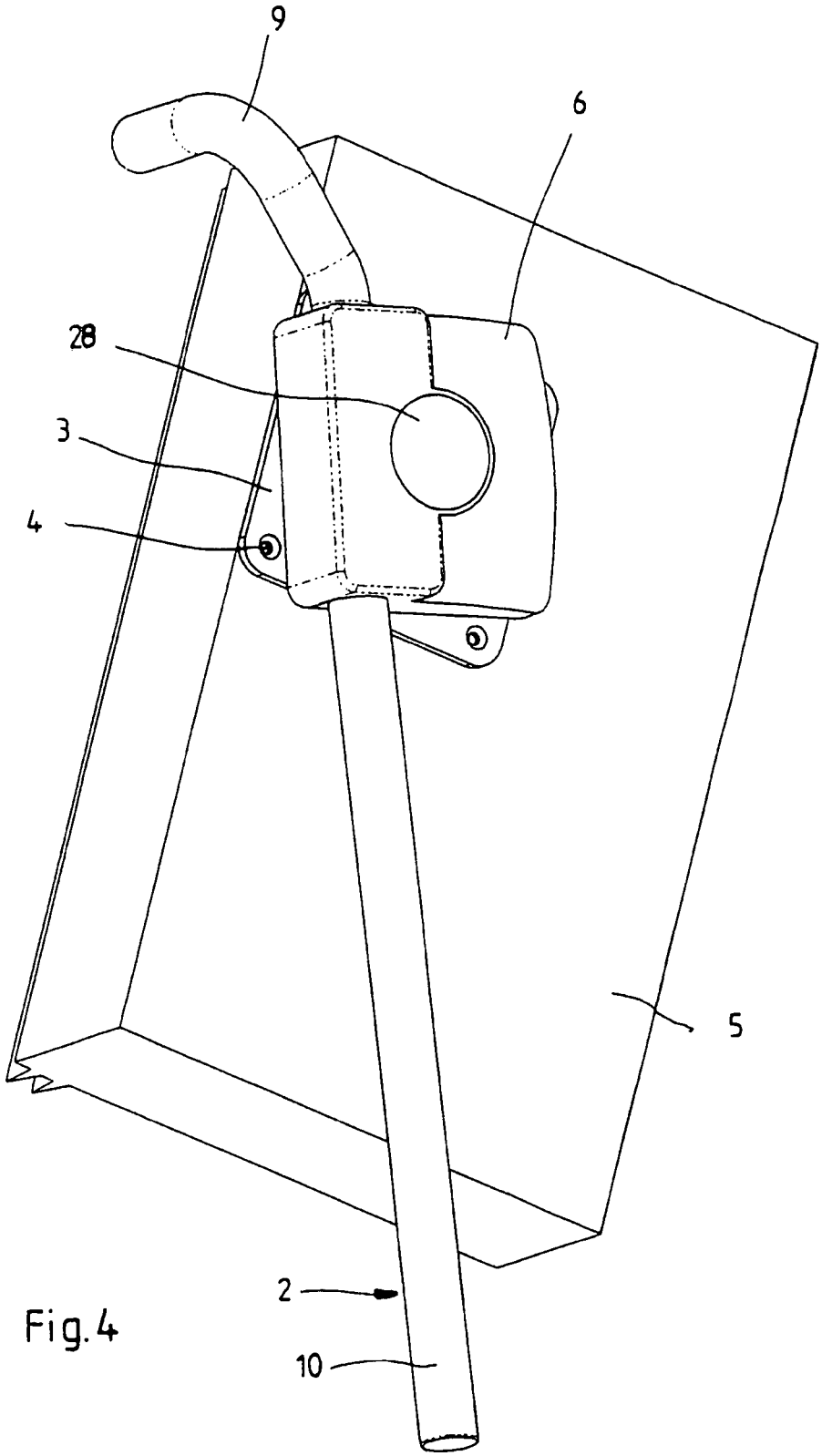
Figure 6:
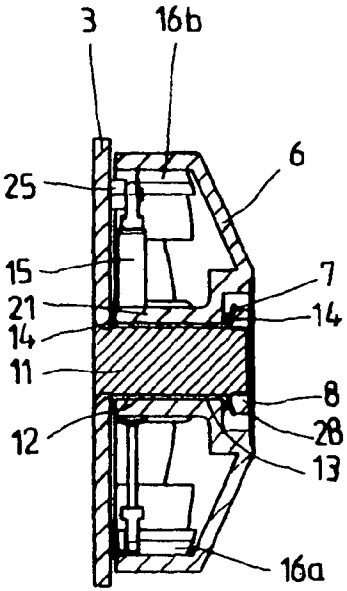
Figure 5:
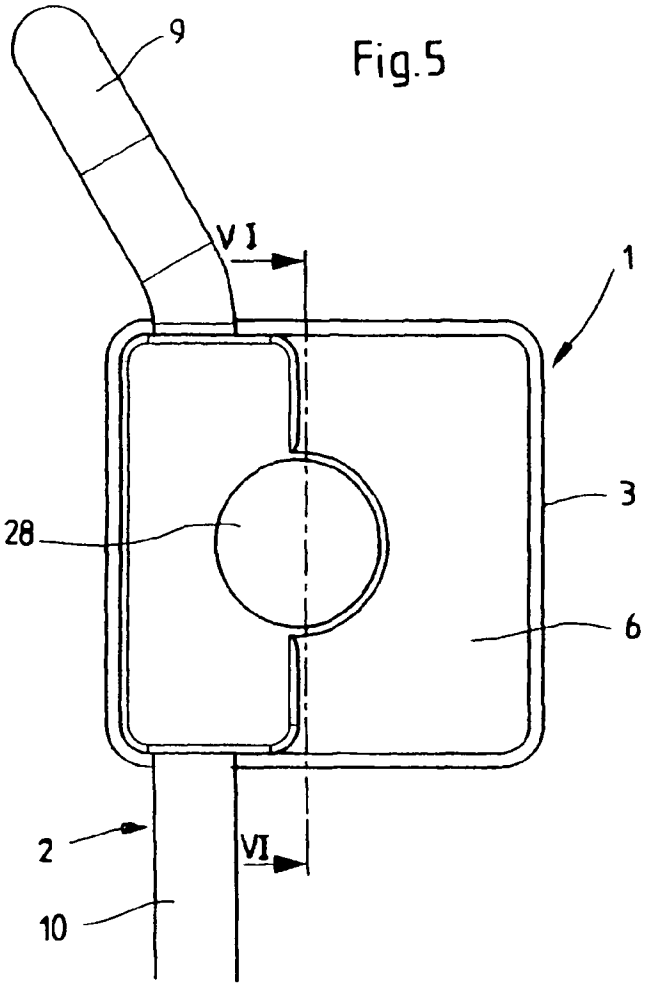
Figure 7:
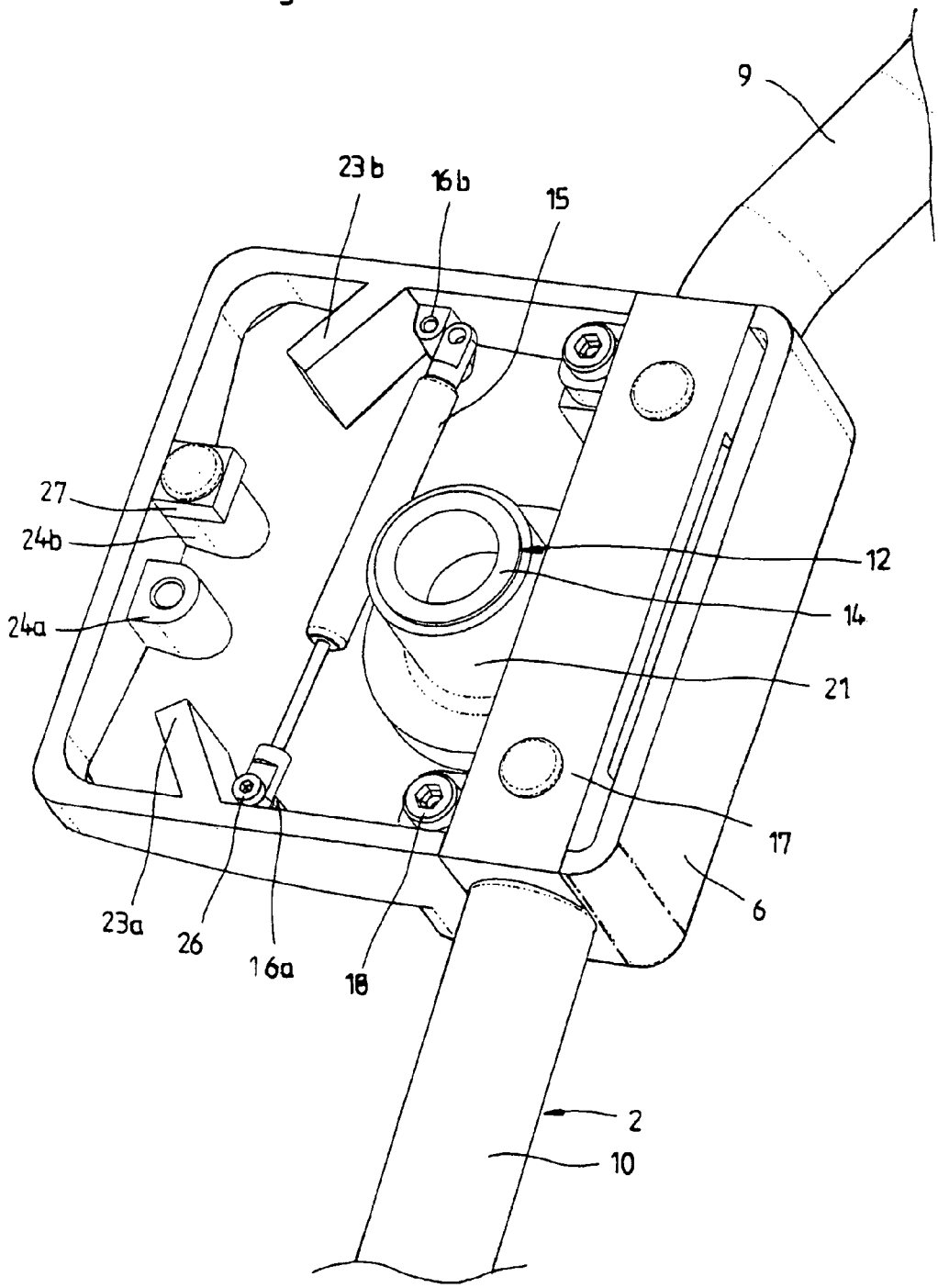
Figure 9:
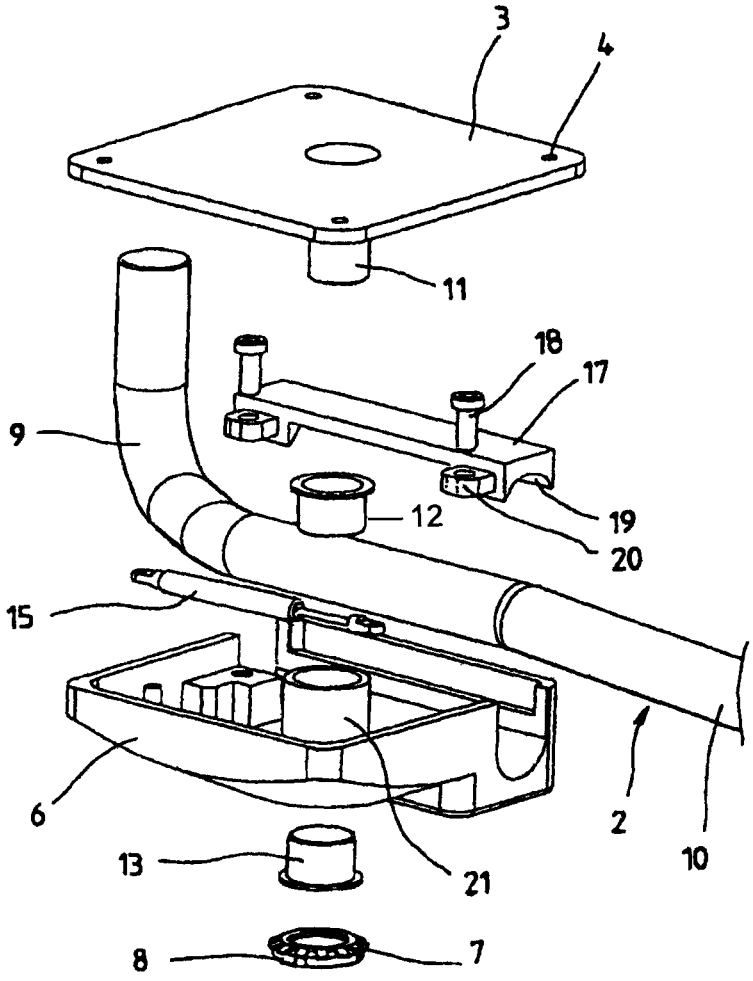
Figure 10:
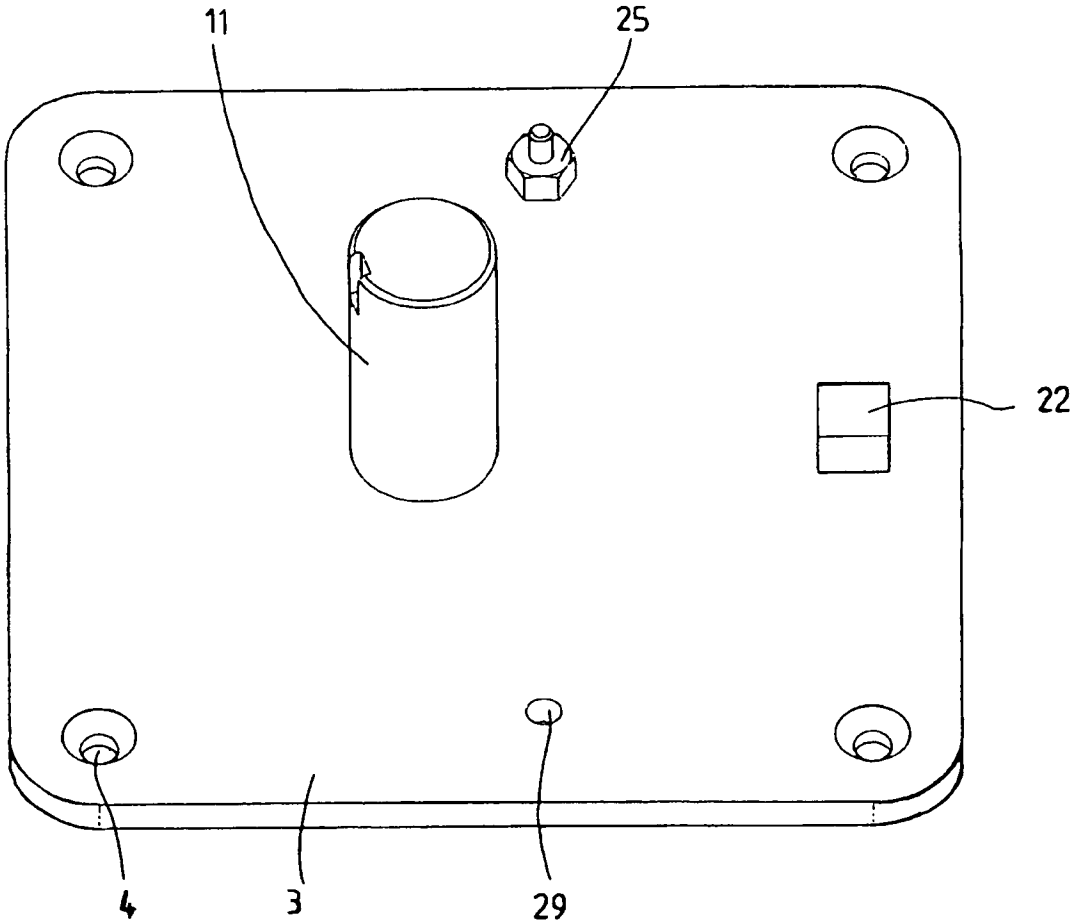

To explain the invention in more detail one embodiment is described in the following with reference to the attached drawings. In this embodiment a sliding door is provided as a closing device. In the drawings it is shown by FIG. 1 an illustration of a swivel bearing with lever arm on a sliding door in a rest position;

FIG. 2 an illustration of a swivel bearing with lever arm on a sliding door in a forced-off position;

FIG. 3 a perspective view of a swivel bearing with lever arm on a sliding door in a rest position;

FIG. 4 a perspective view of a swivel bearing with lever arm on a sliding door in a forced-off position;

FIG. 5 a plan view of a swivel bearing with lever arm;

FIG. 6 a cross section of the swivel bearing with lever arm along line VI-VI in FIG. 5;

FIG. 7 a perspective rear view of the pivotable unit with lever arm;

FIG. 8 a cross section of the swivel bearing with lever arm along line I-I;

FIG. 9 a detailed view of the components of the swivel bearing with lever arm and FIG. 10 a perspective view of the base plate.

The FIGS. 1 to 4 show a possible embodiment of a swivel bearing (1) with a lever arm (2) fixed to the swivel bearing (1). The pressing mechanism which is composed of a swivel bearing (1) and a lever arm (2) is shown in the FIGS. 1 and 3 in its rest position and in the FIGS. 2 and 4 in its forced-off position. In the FIGS. 2 and 4 also the base plate (3) can be seen including bores (4) through which the base plate (3) can be fixed to the sliding door leaf (5) by using screws. Further illustrated in the FIGS. 2 and 4 is the pivotable unit (6) which in this embodiment has an approximately square outline corresponding to the outline of the base plate (3), as can be seen particularly in the FIGS. 1 and 3. To the front side of the pivotable unit (6) a cover (28) is mounted for protection, and under this cover a fixing element is arranged. The lever arm (2) as shown in the FIGS. 1 to 4 includes a load arm (9) which is shorter than the force arm (10) and which is bent with respect to this latter arm. The FIGS. 3 and 4 further show that a part of the load arm (9) is bent vertically to the sliding door. Thus the bent part of the load arm (9) forms a larger force-off surface and provides a good contact surface during removal from an abutment arranged on the door frame or from the door frame itself (not shown).

FIG. 5 shows the swivel bearing (1) and a lever arm (2) in a plan view, wherein the cutting line VI-VI is shown as a cross section in FIG. 6.

FIG. 6 shows a section through approximately the center of a swivel bearing (1). There can be seen a journal (11) arranged on the base plate (3), and on the journal (11) two guide sleeves (12, 13) are provided for guiding the pivotable unit (6). In this embodiment the cylindrical guide sleeves (12, 13) have a continuous bead (14) on one end, which bead spaces the pivotable unit (6) apart from the base plate (3) in the case of the guide sleeve (12). FIG. 6 further shows that the guide sleeve (13) is inserted in the sleeve-like journal (21) of the pivotable unit (6). Due to the nut (8) which is shimmed by a locking ring (7) and screwed to a thread on the journal (11) of the base plate (3) the guide sleeves (12, 13) are contacted with each other, so that zero clearance pivoting of the pivotable unit (6) is given. The nut (8) and the locking ring (7) are covered by a cover (28) as a protection against injuries. Further shown in FIG. 6 is the element (15) which is a combined damper and limiting element. The element (15) is fixed to the pivotable unit (6) via the web (16*a*), and the other end of the element (15) is fixed to the fixing element (25) on the base plate.

FIG. 7 shows a perspective rear view of the pivotable unit (6) with a lever arm (2). In the interior of the pivotable unit (6) the two webs (16*a*, 16*b*) are formed, to which the element (15) can be fixed by means of a screw (26). Further the limit stops (23*a*, 23*b*) can be seen limiting the pivoting movement and striking against the corresponding limit stop (22) of the base plate (3). Furthermore a central limit stop (27) for the vertical position of the pivotable unit (6) is provided which can be selectively screwed to one of the webs (24*a*, 24*b*). Due to the symmetrical arrangement of the webs (16*a*, 16*b*, 24*a*, 24*b*) and the two limit stops (23*a*, 23*b*) the components of the swivel bearing (1) can be used both for sliding doors opening to the right and to the left.

FIG. 8 shows a further cross section through the swivel bearing (1) along line I-I, in which the holding element (17) of the lever arm (2) can be seen, which is fixed to the pivotable unit (6) by the screws (18). In this embodiment the holding element (17) is screwed together on its one side with the pivotable unit (6) and includes a seat (19) which is complementary to the shape of the lever arm (2).

FIG. 9 shows an exploded view of the swivel bearing (1) with a lever arm (2). The base plate (3) with the journal (11) to which a guide sleeve (12) is attached can be seen. The pivotable unit (6) is connected to the lever arm (2) through the holding element (17). In this embodiment and for this purpose the holding element (17) is elongate and constructed as one piece and includes two flanges (20) for receiving the screws (18). The holding element (17) includes a recess (19) which extends on one side over the entire larger surface of the holding element (17), and the recess is formed complementary to the shape of the lever arm (2). The pivotable unit (6) further includes the element (15) which has to be connected to the pivotable unit (6) on one side and to the base plate (3) on the other side. Once the components of the pivotable unit (6) are connected to each other, as illustrated in FIG. 7, the pivotable unit (6) is placed onto the journal (11) of the base plate (3) provided with a guide sleeve (12). Then the second guide sleeve (13) is inserted in the sleeve-like journal (21) of the pivotable unit (6) and fixed to the base plate (3) by means of a fixing element which in this embodiment is formed by nut (8) shimmed by a locking ring (7). Thus the entire swivel bearing (1) is composed of a very small number of components.

FIG. 10 shows a base plate (3) which includes in its center the journal (11) to which the pivotable unit (6) is fixed. There is also shown a screw-like fixing element (25) for the element (15) which can also be arranged on the bore (29), depending on the direction in which the sliding door (6) opens. Further the limit stop (22) corresponding to the limit stops can be seen having a cubic shape and limiting the pivoting movement of the pivotable unit (6).

The described embodiment merely serves to explain the invention in more detail and is in no way limiting.

The invention claimed is:

1. A closing device pressing mechanism including a swivel bearing and a lever arm, said closing device pressing mechanism adapted to prevent and allow movement of a closing device, the swivel bearing comprising:

a base plate fixed to the closing device, the base plate has a first journal shaped as a pin or a bolt;

a first guide sleeve fixed to the first journal;

a pivotable unit configured to receive the lever arm, the pivotable unit is pivotable with respect to the base plate; and a second journal arranged on the pivotable unit, the second journal being shaped as a sleeve in order to receive the first journal of the base plate provided with the first guide sleeve, the second journal is in contact with the first guide sleeve.

2. The closing device pressing mechanism according to claim 1, wherein a second guide sleeve is directly fixed to the first journal.

3. The closing device pressing mechanism according to claim 1, wherein the pivotable unit is constructed as a housing.

4. The closing device pressing mechanism according to claim 1, wherein the lever arm is fixed to the pivotable unit at a position offset from each of the first journal, the second journal, and the first guide sleeve.

5. The closing device pressing mechanism according to claim 4, wherein the lever arm includes a force arm and a load arm on opposite sides of the swivel bearing, wherein the load arm is shorter than a force arm of the lever arm.

6. The closing device pressing mechanism according to claim 5, wherein the load arm is bent as compared to the force arm.

7. The closing device pressing mechanism according to claim 6, wherein the load arm includes an additional bend vertically to a plane of the closing device.

8. The closing device pressing mechanism according to claim 4, wherein the pivotable unit includes a holding element for fixing the lever arm.

9. The closing device pressing mechanism according to claim 1, further comprising a damper element.

10. The closing device pressing mechanism according to claim 9, wherein the damper element includes a connection to the base plate.

11. The closing device pressing mechanism according to claim 1, wherein the pivotable unit includes at least one limiting element.

* * * * *